US012325102B2

(12) United States Patent
Suen et al.

(10) Patent No.: US 12,325,102 B2
(45) **Date of Patent: *Jun. 10, 2025**

(54) CHEMICAL MECHANICAL POLISHING APPARATUS AND METHOD

(71) Applicant: Taiwan Semiconductor Manufacturing Co., Ltd., Hsinchu (TW)

(72) Inventors: Shich-Chang Suen, Hsinchu (TW); Liang-Guang Chen, Hsinchu (TW); Kei-Wei Chen, Tainan (TW)

(73) Assignee: Taiwan Semiconductor Manufacturing Company, Ltd., Hsinchu (TW)

( * ) Notice: Subject to any disclaimer, the term of this patent is extended or adjusted under 35 U.S.C. 154(b) by 840 days.

This patent is subject to a terminal disclaimer.

(21) Appl. No.: 17/222,005

(22) Filed: Apr. 5, 2021

(65) Prior Publication Data

US 2021/0220962 A1 Jul. 22, 2021

Related U.S. Application Data

(63) Continuation of application No. 16/031,899, filed on Jul. 10, 2018, now Pat. No. 10,967,478.

(Continued)

(51) Int. Cl.

*B24B 37/04* (2012.01)
*B24B 37/20* (2012.01)

(Continued)

(52) U.S. Cl.

CPC ..... *B24B 37/046* (2013.01); *B24B 37/044* (2013.01); *B24B 37/20* (2013.01); *B24B 37/22* (2013.01); *B24B 37/24* (2013.01)

(58) Field of Classification Search

CPC ..... B24B 1/002; B24B 57/00; B24B 57/02; B24B 7/228; B24B 37/005;

(Continued)

(56) References Cited

U.S. PATENT DOCUMENTS 5,078,801 A 1/1992 Malik
5,575,706 A * 11/1996 Tsai ..... B24B 57/02 451/36

(Continued)

FOREIGN PATENT DOCUMENTS

CN 1522833 A 8/2004
CN 101573212 A 11/2009

(Continued)

OTHER PUBLICATIONS

TWM540715—Machine Translation (Year: 2017).*
JP2000108002—Machine Translation (Year: 200).*

*Primary Examiner* — Brian D Keller
*Assistant Examiner* — Alberto Saenz
(74) *Attorney, Agent, or Firm* — Slater Matsil, LLP

(57) ABSTRACT

A polishing platform of a polishing apparatus includes a platen, a polishing pad, and an electric field element disposed between the platen and the polishing pad. The polishing apparatus further includes a controller configured to apply voltages to the electric field element. A first voltage is applied to the electric field element to attract charged particles of a polishing slurry toward the polishing pad. The attracted particles reduce overall topographic variation of a polishing surface presented to a workpiece for polishing. A second voltage is applied to the electric field element to (Continued)

attract additional charged particles of the polishing slurry toward the polishing pad. The additional attracted particles further reduce overall topographic variation of the polishing surface presented to the workpiece. A third voltage is applied to the electric field element to repel charged particles of the polishing slurry away from the polishing pad for improved cleaning thereof.

20 Claims, 13 Drawing Sheets

Related U.S. Application Data

(60) Provisional application No. 62/565,760, filed on Sep. 29, 2017.

(51) Int. Cl.
*B24B 37/22* (2012.01)
*B24B 37/24* (2012.01)

(58) Field of Classification Search
CPC ... B24B 37/0056; B24B 37/04; B24B 37/042; B24B 37/046; B24B 37/10; B24B 37/105; B24B 37/107; B24B 37/20; B24B 55/12; H01L 21/302; H01L 21/304; H01L 21/32125
USPC ..... 451/41
See application file for complete search history.

(56) References Cited

U.S. PATENT DOCUMENTS

| | | | | |
|---|---|---|---|---|
| 5,807,165 | A * | 9/1998 | Uzoh | B24B 37/04 205/663 |
| 6,066,030 | A | 5/2000 | Uzoh | |
| 6,663,469 | B2 | 12/2003 | Kimura et al. | |
| 6,857,940 | B2 | 2/2005 | Akagami et al. | |
| 6,872,123 | B2 | 3/2005 | Sudo et al. | |
| 7,125,324 | B2 | 10/2006 | Palmgren et al. | |
| 7,129,160 | B2 | 10/2006 | Chopra | |
| 7,255,784 | B2 | 8/2007 | Sato et al. | |
| 7,374,644 | B2 | 5/2008 | Butterfield et al. | |
| 7,790,015 | B2 | 9/2010 | Wang et al. | |
| 8,758,090 | B2 | 6/2014 | Shao et al. | |
| 9,227,294 | B2 | 1/2016 | Cheng et al. | |
| 9,950,405 | B2 | 4/2018 | Deng | |
| 10,065,288 | B2 | 9/2018 | Wu et al. | |
| 10,350,726 | B2 | 7/2019 | Liang et al. | |
| 2006/0003670 | A1 * | 1/2006 | Golzarian | B24B 37/042 451/5 |
| 2010/0059390 | A1 | 3/2010 | Li | |
| 2014/0063590 | A1 | 3/2014 | Myoung et al. | |
| 2015/0183081 | A1 * | 7/2015 | Deng | H01L 21/30625 438/693 |
| 2015/0275048 | A1 | 10/2015 | Dylla-Spears et al. | |

FOREIGN PATENT DOCUMENTS

| | | | | |
|---|---|---|---|---|
| CN | 104742007 | A | | 7/2015 |
| JP | 2000108002 | A | * | 4/2000 |
| TW | M540715 | U | * | 5/2017 |

* cited by examiner

CHEMICAL MECHANICAL POLISHING APPARATUS AND METHOD

PRIORITY CLAIM AND CROSS-REFERENCE

This application is a continuation of U.S. patent application Ser. No. 16/031,899, filed Jul. 10, 2018 and entitled "Chemical Mechanical Polishing Apparatus and Method," now U.S. Pat. No. 10,967,478, issued on Apr. 6, 2021, which claims priority to U.S. Provisional Application Ser. No. 62/565,760, filed Sep. 29, 2017 and entitled "Chemical Mechanical Polishing Apparatus and Method," which applications are hereby incorporated by reference herein as if reproduced in their entirety.

BACKGROUND

Generally, semiconductor devices comprise active components (e.g., transistors) formed on a substrate. Any number of interconnect layers may be formed over the substrate connecting active components to each other and to other devices. The interconnect layers may be fabricated from low-k dielectric material layers with metallic trenches/vias disposed therein. As the layers of a device are formed, the device is sometimes planarized. For example, the formation of metallic features in a substrate or in a metal layer may cause uneven surface topography. This uneven topography can cause problems with formation of subsequent layers. In some cases, uneven topography may interfere with subsequent photolithographic processes used to form various features in a device. Therefore, it may be desirable to planarize a surface of a device after various features or layers are formed.

A commonly-used method of planarization is chemical mechanical polishing (CMP). Typically, CMP involves placing a wafer in a carrier head, where the wafer is held in place by a retaining ring. The carrier head and the wafer are then rotated as downward pressure is applied to the wafer against a polishing pad. A chemical solution, referred to as a slurry, is deposited onto the surface of the polishing pad to aid planarization. The surface of a wafer may be planarized using a combination of mechanical and chemical mechanisms.

BRIEF DESCRIPTION OF THE DRAWINGS

Aspects of the present disclosure may be best understood from the following detailed description when read with the accompanying Figures. It is noted that, in accordance with standard practice in the industry, various features may not be illustrated to scale. In fact, dimensions of various features may be arbitrarily increased or reduced for clarity of discussion or illustration.

DETAILED DESCRIPTION

Figure 1:
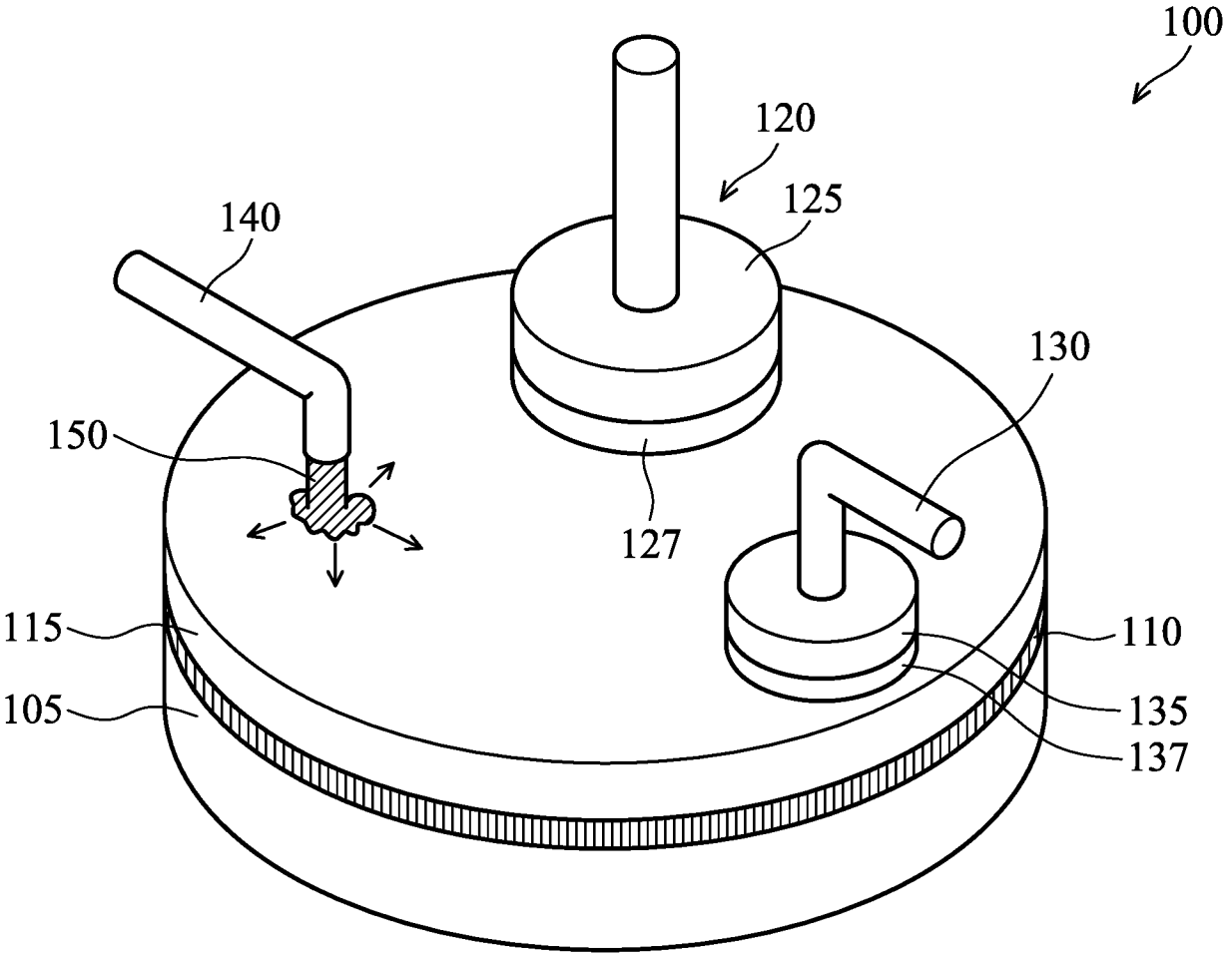
FIG. 1 representatively illustrates a three-quarter isometric view of a polishing apparatus, in accordance with some embodiments.

The following disclosure provides different embodiments, or examples, for implementing different features. Specific examples of components and arrangements are included herein to simplify description. These are, of course, merely examples and are not intended to be limiting. For example, formation of a first feature "over" or "on" a second feature in the description that follows may include embodiments in which first and second features are formed in direct contact, and may also include embodiments in which additional features may be formed between first and second features, such that the first and second features may not be in direct contact. Additionally, the present disclosure may repeat reference numerals or letters in various examples. This repetition is for the purpose of simplicity and clarity, and does not in itself indicate a relationship between various embodiments or configurations discussed herein.

Further, spatially relative terms, such as "beneath," "below," "lower," "above," "upper," or the like, may be used herein for ease of description to describe one element or feature's relationship to another element or feature. Spatially relative terms are intended to encompass different orientations of a device in use or operation, in addition to orientations illustrated in the Figures. An apparatus may be otherwise oriented (e.g., rotated by 90 degrees, or at other orientations) and spatially relative descriptors used herein may likewise be interpreted accordingly.

Various embodiments are described with respect to a specific context—namely, a chemical mechanical polishing (CMP) apparatus and a method of planarizing a workpiece using the CMP apparatus. In a representative aspect, the workpiece may include a semiconductor wafer presented for CMP processing.

FIG. 1 illustrates a three-quarter isometric view of a CMP apparatus 100 in accordance with representative embodiments. In some embodiments, CMP apparatus 100 includes a platen 105 over which a polishing pad 115 is placed. An electric field element 11*o* (described in greater detail later, e.g., with reference to FIGS. 4-8) is disposed between platen 105 and polishing pad 115.

In some embodiments, polishing pad 115 may include a single layer or a composite layer of materials such as felts, polymer impregnated felts, microporous polymers films, microporous synthetic leathers, filled polymer films, unfilled textured polymer films, combinations of same, or the like. Representative polymers may include polyurethane, polyolefins, or the like.

In some embodiments, a polisher head 120 is placed over polishing pad 115. Polisher head 120 includes a carrier 125 and a retainer ring 127. In some embodiments, retainer ring 127 is mounted to carrier 125 using mechanical fasteners, e.g., screws or any other suitable attachment means. During a CMP process, a workpiece (e.g., a semiconductor wafer; not shown in FIG. 1) is placed within carrier 125 and is held by retainer ring 127. In some embodiments, retainer ring 127 has a substantially annular shape with a substantially hollow center. The workpiece is placed in the center of retainer ring 127 such that retainer ring 127 holds the workpiece in place during a CMP process. The workpiece is positioned such that a surface to be polished faces downward towards polishing pad 115. Carrier 125 is configured to apply a downward force or pressure urging the workpiece into contact with polishing pad 115. Polisher head 120 is configured to rotate the workpiece over polishing pad 115 during planarization/polishing.

In some embodiments, CMP apparatus 100 includes a slurry dispenser 140 configured to deposit a slurry 150 onto polishing pad 115. Platen 105 is configured to rotate causing slurry 150 to be distributed between the workpiece and platen 105 through a plurality of grooves (not illustrated) in retainer ring 127, which may extend from an outer sidewall of retainer ring 127 to an inner sidewall of retainer ring 127. Given compositions of slurry 150 depend on types of material to be polished or removed. For example, slurry 150 may comprise a reactant, an abrasive, a surfactant, and a solvent. The reactant may be a chemical, such as an oxidizer or a hydrolyzer, which will chemically react with a material of the workpiece in order to assist polishing pad 115 in abrading/removing material. In some embodiments in which material to be removed includes tungsten, the reactant may be, e.g., hydrogen peroxide; although any other suitable reactant, such as hydroxylamine, periodic acid, ammonium persulfate, other periodates, iodates, peroxomonosulfates, peroxymonosulfuric acid, perborates, malonamide, combinations of these, or the like, configured to aid in removal of material may be alternatively, conjunctively, or sequentially employed. Other reactants may be used to remove other types of materials. For example, in some embodiments in which a material to be removed includes an oxide, the reactant may comprise $HNO_3$, KOH, $NH_4OH$, combinations of same, or the like.

The abrasive may include any suitable particulate that, in conjunction with polishing pad 115, is configured to polish/planarize the workpiece. In some embodiments, the abrasive may include silica, aluminum oxide, cerium oxide, polycrystalline diamond, polymer particles (e.g., polymethacrylate, or the like), combinations of these, or the like. In a representative aspect, abrasive particles may be selected or otherwise configured to carry an electrokinetic charge as a function of the negative log of hydronium ion concentration (pH) of slurry 150, e.g., as discussed later herein with reference to FIG. 12.

A surfactant may be utilized to help disperse the reactant and abrasive within slurry 150, and to prevent (or otherwise reduce) abrasive from agglomerating during a CMP process. In some embodiments, the surfactant may include sodium salts of polyacrylic acid, potassium oleate, sulfosuccinates, sulfosuccinate derivatives, sulfonated amines, sulfonated amides, sulfates of alcohols, alkyl aryl_sulfonates, carboxylated alcohols, alkylamino propionic acids, alkyliminodipropionic acids, combinations of same, or the like. However, such representative embodiments are not intended to be limited to the recited surfactants, as any suitable surfactant may be alternatively, conjunctively, or sequentially employed.

A remaining portion of slurry 150 may include a solvent that may be utilized to combine reactant(s), abrasive(s), and surfactant(s), and allow the mixture to be moved and dispersed onto polishing pad 115. In some embodiments, a solvent of slurry 150 may include, e.g., deionized (DI) water or an alcohol; however, any other suitable solvent may be alternatively, conjunctively, or sequentially employed.

In some embodiments, CMP apparatus 100 includes a pad conditioner 137 attached to a pad conditioner head 135. Pad conditioner head 135 is configured to rotate pad conditioner 137 over polishing pad 115. In some embodiments, pad conditioner 137 is mounted to pad conditioner head 135 using mechanical fasteners, e.g., screws or by any other suitable means. A pad conditioner arm 130 is attached to pad conditioner head 135, and is configured to move pad conditioner head 135 and pad conditioner 137 in a sweeping motion across a region of polishing pad 115. In some embodiments, pad conditioner head 135 is mounted to pad conditioner arm 130 using mechanical fasteners, e.g., screws or by any other suitable means. In some embodiments, pad conditioner 137 comprises a substrate over which an array of abrasive particles is bonded using, for example, electroplating. Pad conditioner 137 removes built-up wafer debris and excess slurry from polishing pad 115 during CMP processing. In some embodiments, pad conditioner 137 also acts as an abrasive for polishing pad 115 to create a desired texture (such as, for example, grooves, or the like) against which the workpiece may be polished.

As representatively illustrated in FIG. 1, CMP apparatus 100 has a single polisher head (e.g., polisher head 120) and a single polishing pad (e.g., polishing pad 115); however, in other embodiments, CMP apparatus 100 may have multiple polisher heads and/or multiple polishing pads. In some embodiments in which CMP apparatus 100 has multiple polisher heads and a single polishing pad, multiple workpieces (e.g., semiconductor wafers) may be polished at a same time. In other embodiments in which CMP apparatus 100 has a single polisher head and multiple polishing pads, a CMP process may be a multi-step process. In such embodiments, a first polishing pad may be used for bulk material removal from a wafer, a second polishing pad may be used for global planarization of the wafer, and a third polishing pad may be used to buff a surface of the wafer. In some embodiments, different slurry compositions may be used for different CMP stages. In still other embodiments, a same slurry composition may be used for all CMP stages.

Figure 2:
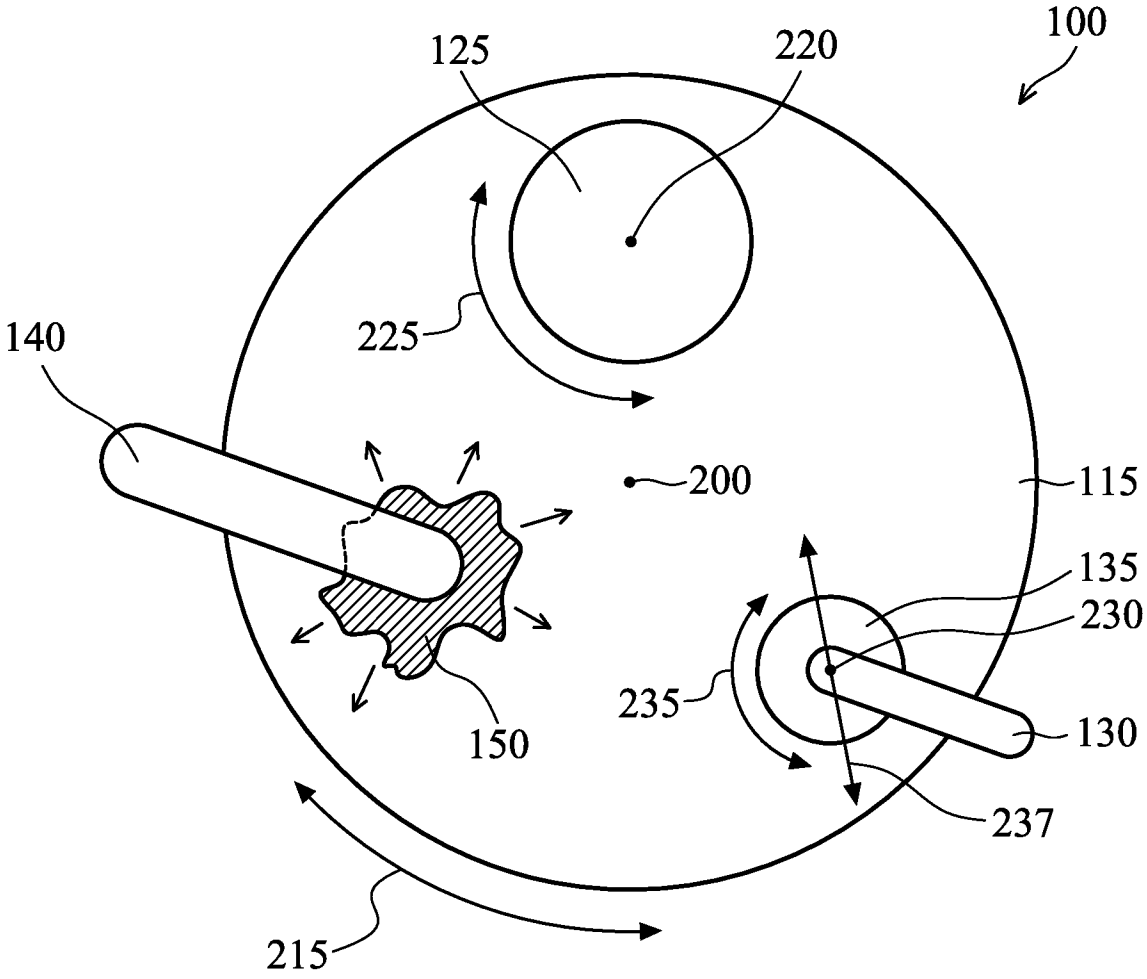
FIG. 2 representatively illustrates a plan view of a polishing apparatus in accordance with some embodiments.

FIG. 2 representatively illustrates a top/plan view of CMP apparatus 100 in accordance with some embodiments. Platen 105 is configured to rotate in a clockwise or a counter-clockwise direction, indicated by a double-headed arrow 215 around an axis extending through centrally-disposed point 200, which is a center point of platen 105. Polisher head 120 is configured to rotate in a clockwise or a counter-clockwise direction, indicated by a double-headed arrow 225 around an axis extending through point 220, which is a center point of polisher head 120. The axis through point 200 may be parallel to the axis through point 220. The axis through point 200 may be spaced apart from the axis through point 220. In some embodiments, pad conditioner head 135 is configured to rotate in a clockwise or a counter-clockwise direction, indicated by a double-headed arrow 235 around an axis extending through point 230, which is a center point of pad conditioner head 135. The axis through point 200 may be parallel to the axis through point 230. Pad conditioner arm 130 is configured to move pad conditioner head 135 in an effective arc during rotation of platen 105, as indicated by double-headed arrow 237.

Figure 3:
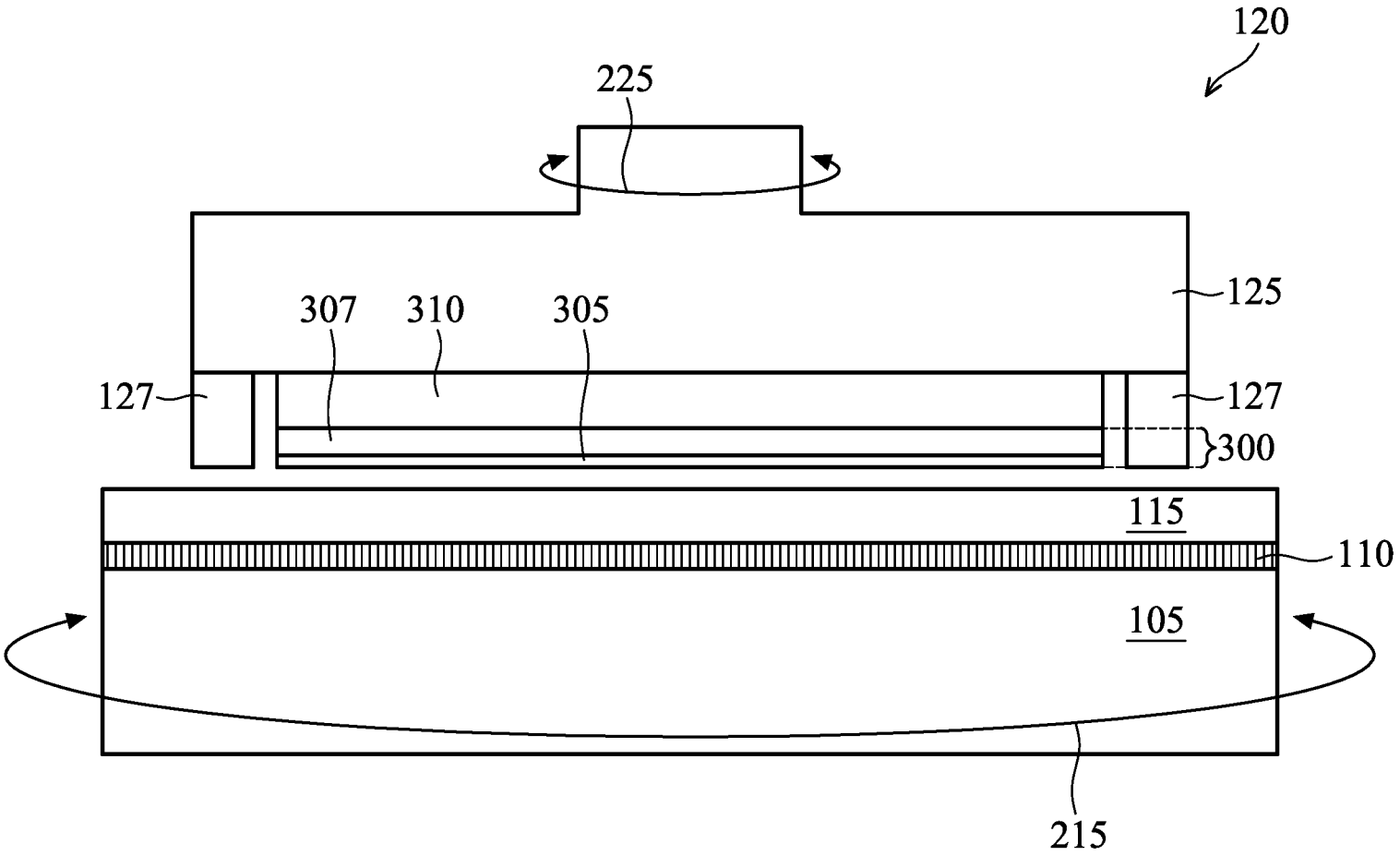
FIG. 3 representatively illustrates an elevation cross-section view of a polisher head, in accordance with some embodiments.

FIG. 3 representatively illustrates an elevation cross-section view of polisher head 120, in accordance with some embodiments. In some embodiments, carrier 125 incudes a membrane 310 configured to interface with a wafer 300 during a CMP process. In some embodiments, CMP apparatus 100 includes a vacuum system (not shown) coupled to polisher head 120, and membrane 310 is configured to pick up and hold wafer 300 using vacuum suction onto membrane 310. In some embodiments, wafer 300 may be a semiconductor wafer comprising, for example, a semiconductor substrate (e.g., comprising silicon, a III-V semiconductor material, or the like), active devices (e.g., transistors, or the like) on the semiconductor substrate, and/or various interconnect structures. Representative interconnect structures may include conductive features, which electrically connect active devices in order to form functional circuits. In various embodiments, CMP processing may be applied to wafer 300 during any stage of manufacture in order to planarize or otherwise remove features (e.g., dielectric material, semiconductor material, conductive material, or the like) of wafer 300. Wafer 300 may include any subset of the above-identified features, as well as other features. In representative aspects, wafer 300 comprises bottommost layer(s) 305 and overlying layer(s) 307. In some embodiments, bottommost layer 305 is subjected to polishing/planarization during a CMP process. In some embodiments in which bottommost layer 305 comprises tungsten, bottommost layer 305 may be polished to form, e.g., contact plugs contacting various active devices of wafer 300. In some embodiments in which bottommost layer 305 comprises copper, bottommost layer 305 may be polished to form, e.g., various interconnect structures of wafer 300. In some embodiments in which bottommost layer 305 comprises a dielectric material, bottommost layer 305 may be polished to form, e.g., shallow trench isolation (STI) structures on wafer 300.

In some embodiments, bottommost layer 305 may have a non-uniform thickness (e.g., exhibiting topological variation of an exposed surface of bottommost layer 305) resulting from process variations experienced during formation of bottommost layer 305. For example, in accordance with a representative aspect, bottommost layer 305 may be formed by depositing tungsten using a chemical vapor deposition (CVD) process. Due to CVD process variations, bottommost layer 305 may have a non-uniform thickness that ranges from about 100 nm to about 500 nm, with a mean value of about 250 nm, and a standard deviation of about 25 nm.

In some embodiments, a thickness profile of bottommost layer 305 may be measured using ellipsometry, interferometry, reflectometry, picosecond ultrasonics, atomic force microscopy (AFM), scanning tunneling microscopy (STM), scanning electron microscopy (SEM), transmission electron microscopy (TEM), or the like. In some embodiments, a thickness measurement apparatus (not shown) may be external to CMP apparatus 100, and a thickness profile of bottommost layer 305 may be measured or otherwise determined before loading wafer 300 into CMP apparatus 100. In other embodiments, a thickness measurement apparatus (not illustrated) may be a part of CMP apparatus 100, and a thickness profile of bottommost layer 305 may be measured or otherwise determined after loading wafer 300 into CMP apparatus 100.

Figure 4:
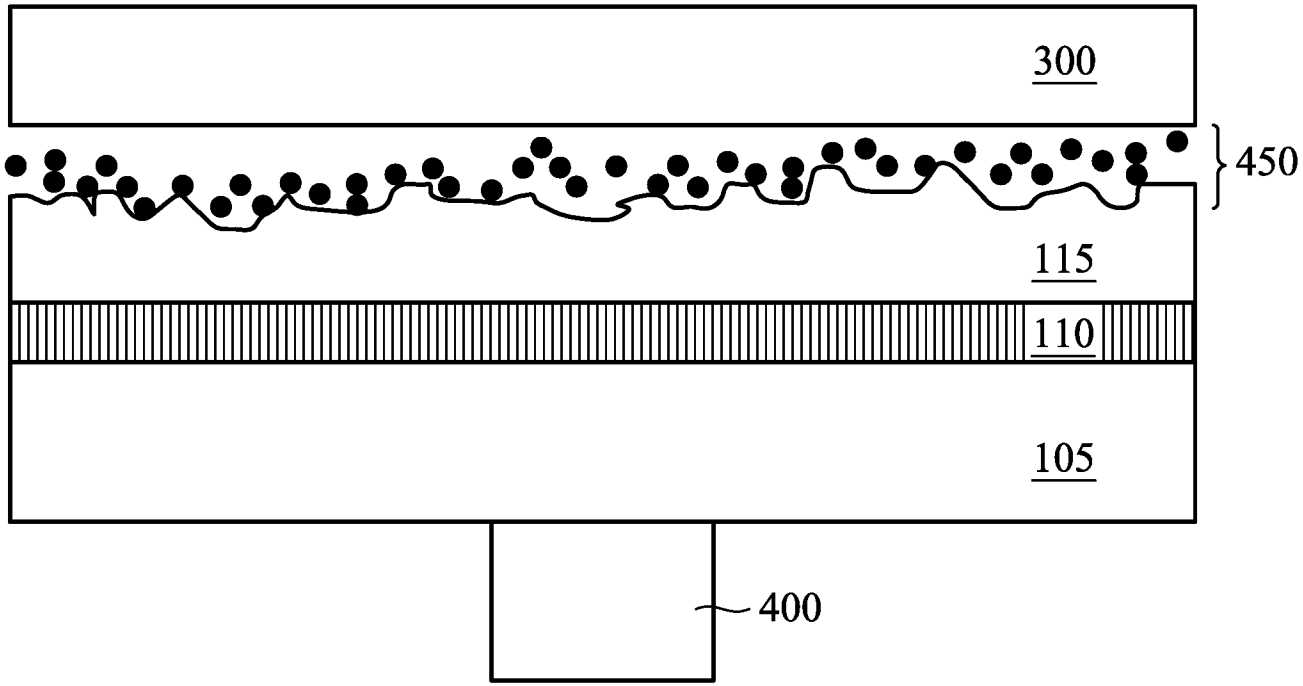
FIGS. 4-6 representatively illustrate elevation cross-section views of a polishing apparatus and polishing methods, in accordance with some embodiments.

As representatively illustrated in FIG. 4, platen 105 is affixed to chuck 400. In some embodiments, chuck 400 is rotated to engage rotation 215 of platen 105. Electric field element 110 is interposed between platen 105 and polishing pad 115. In some embodiments, electric field element 110 may include a plate, a mesh, a combination thereof, or the like. Wafer 300 is positioned over polishing pad 115, with abrasive particles (see arrangement 450 of charged abrasive particles) of slurry disposed therebetween. The abrasive particles are configured to mechanically abrade material from wafer 300 during CMP processing.

Polishing pad 115, electric field element 110, and platen 105 may together form a polishing platform. Wafer 300 is polished by rotating polisher head 120 and/or polishing pad 115/electric field element 110/platen 105 (the polishing platform), as indicated by double-headed arrows 225 and 215 in FIG. 2, respectively. In some embodiments, polisher head 120 and the polishing platform may be rotated in a same direction. In other embodiments, polisher head 120 and polishing platform may be rotated in opposite directions. By rotating wafer 300 against polishing pad 115 of the polishing platform, polishing pad 115 mechanically abrades bottommost layer 305 of wafer 300 to remove undesirable material from bottommost layer 305.

Slurry 150 is dispensed over a top surface of polishing pad 115 by slurry dispenser 140 (shown in FIG. 2). In some embodiments, a gap may be disposed between retainer ring 127 and the polishing pad 115 to allow slurry 150 to be distributed under bottommost layer 305 of wafer 300. In other embodiments, retainer ring 127 may contact polishing pad 115, and slurry 150 may be distributed under bottommost layer 305 of wafer 300 using one or more grooves (not illustrated) extending from an outer sidewall to an inner sidewall of retainer ring 127.

Pad conditioner arm 130 may move pad conditioner head 135 and pad conditioner 137 in a sweeping motion over a region of polishing pad 115. Pad conditioner 137 may be used to remove built-up wafer debris and/or excess slurry from polishing pad 115. Pad conditioner 137 may also be employed to impart a desired texture to polishing pad 115, against which wafer 300 may be mechanically abraded. In some embodiments, pad conditioning head 135/pad conditioner 137 may rotate in directions indicated by double-headed arrow 235. In some embodiments, pad conditioning head 135/pad conditioner 137 and platen 105/electric field element 110/polishing pad 115 may rotate in a same direction. In other embodiments, pad conditioning head 135/pad conditioner 137 and the polishing platform may rotate in opposite directions. In some embodiments, pad conditioner arm 130 may move pad conditioning head 135/pad conditioner 137 in an effective are indicated by double-headed arrow 237. In some embodiments, a range of an are corresponds to a size of carrier 125. For example, carrier 125 may be larger than 300 mm in diameter to accommodate 300 mm wafers. Accordingly, the arc would extend from a perimeter of platen 105/electric field element 110/polishing pad 115 to a distance of at least 300 mm inward from the perimeter. This ensures that any portion of polishing pad 115 that may contact wafer 300 is conditioned appropriately. Skilled artisans will recognize that numbers given herein are representative, and that actual dimensions of carrier 125, and a corresponding range of effective are, may vary depending on dimensions of wafer 300 being polished/planarized.

In representative embodiments, abrasive particles within slurry 150 may be selected or otherwise configured to have an electrokinetic charge (of positive or negative polarity). For example, in an embodiment in which the abrasive particles are desired to have a positive charge, the abrasive particles may be aluminum oxide ($Al_2O_3$), cerium oxide ($CeO_2$), silicon oxide ($SiO_2$) combinations of these, or the like. In other embodiments in which the abrasive particles are desired to have a negative charge, the abrasive particles may be silicon oxide ($SiO_2$), aluminum oxide ($Al_2O_3$), titanium oxide ($TiO_2$), combinations of these, or the like. In an embodiment where no voltage (e.g., zero voltage 1220, FIG. 12) is applied to electric field element 110, arrangement 450 of charged abrasive particles has a quasi-random distribution relative to uppermost surface of polishing pad 115, as representatively illustrated in FIG. 4.

Figure 5:
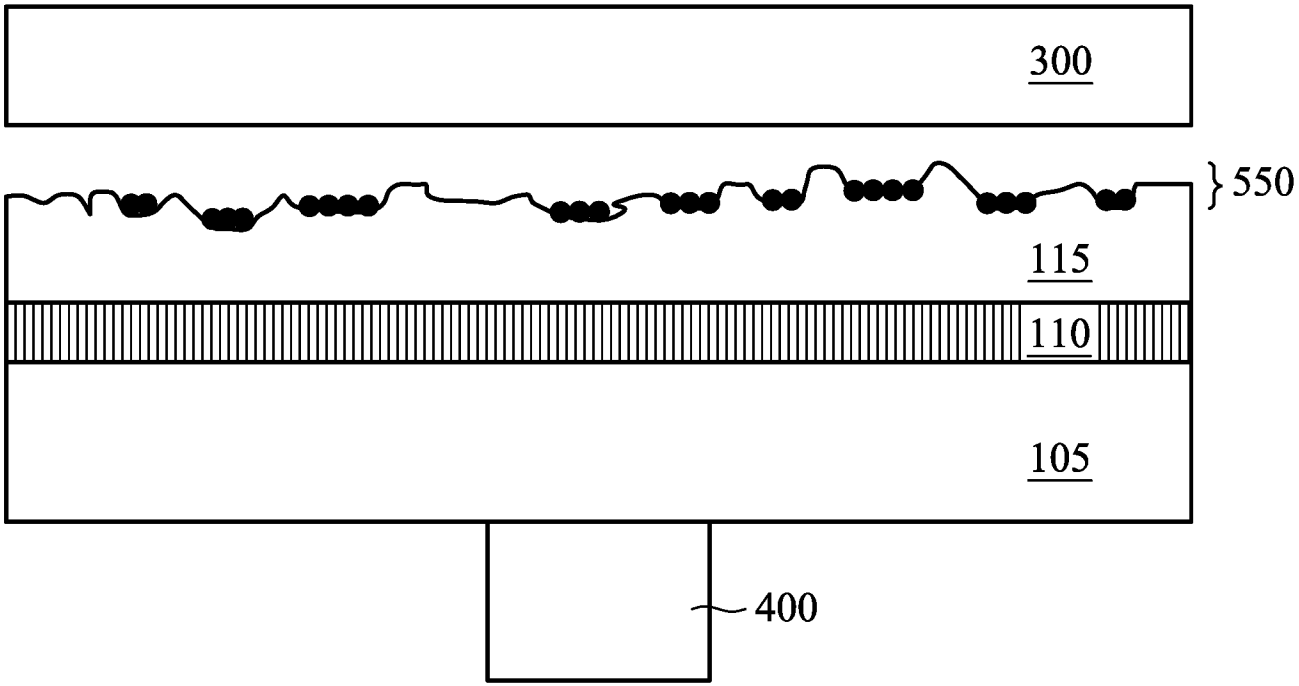

As representatively illustrated in FIG. 5, as a first voltage (e.g., first voltage 1223, FIG. 12) is applied to electric field element 110, a charge (e.g., opposite in polarity to that of the charged abrasive particles) is developed in/on electric field element 110. In an embodiment the first voltage may be between about 10 V and about 50 V, such as about 30 V, and may be applied to electric field element 110 with a conductive element in electrical contact with electric field element 110. For example, chuck 400 may include a brush contact configured to electrically connect a voltage controller (e.g., voltage controller 1305 as discussed later herein with reference to CMP system 1300, representatively illustrated in FIG. 13) to electric field element 110. The developed charge in/on electric field element 110 electrostatically attracts oppositely charged abrasive particles toward polishing pad 115—at least partially filling in lower-lying regions of varied surface topography of polishing pad 115. As a result, overall topographic variation of a polishing surface formed by polishing pad 115 and arrangement 550 of electrostatically attracted charged particles is reduced.

Figure 6:
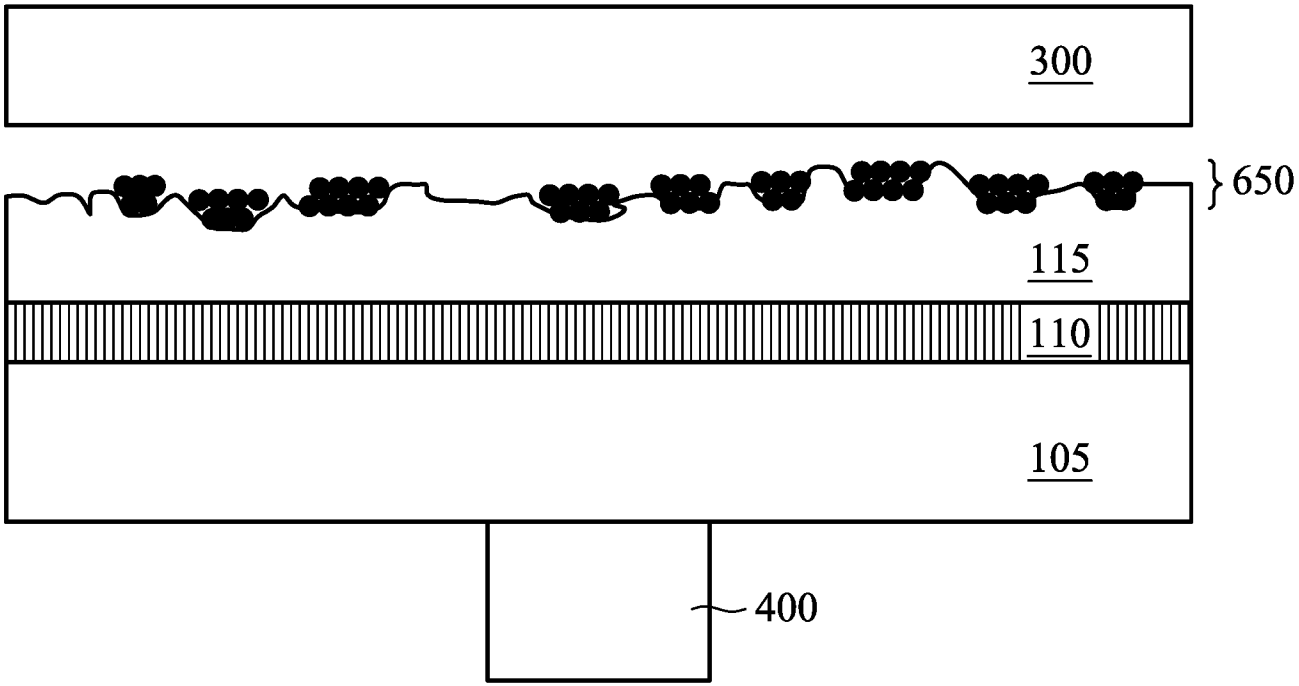
Figure 7:
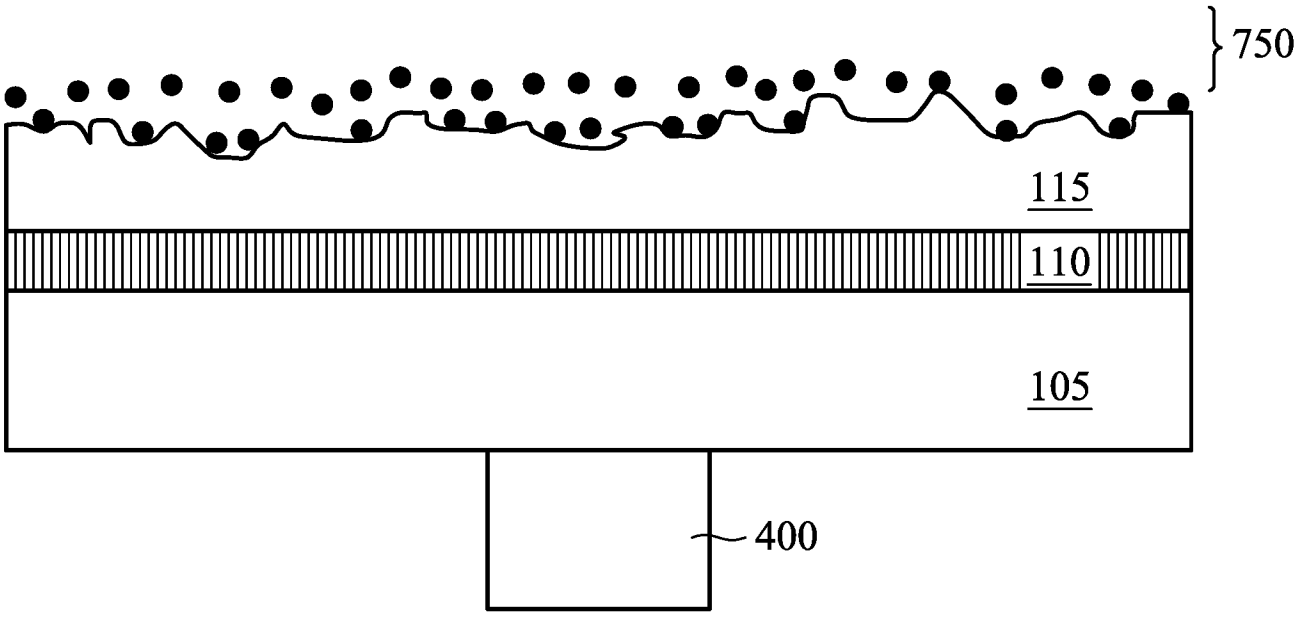
FIGS. 7 and 8 representatively illustrate elevation cross-section views of a polishing apparatus and rinsing methods, in accordance with some embodiments.

As representatively illustrated in FIG. 6, as a second voltage (e.g., second voltage 1225, FIG. 12), having a greater magnitude than (but same polarity as) the first voltage, is applied to electric field element 110, additional charge is developed in/on electric field element 110. In an embodiment the second voltage may be between about 10 V and about 100 V, such as about 50 V. Opposing polarity of the additional charge deposited in/on electric field element 110 electrostatically attracts additional oppositely charged abrasive particles toward polishing pad 115—at least further partially filling in lower-lying regions of varied surface topography of polishing pad 115. As a result, overall topographic variation of a polishing surface (e.g., formed by polishing pad 115 and arrangement 650 of additionally attracted charged abrasive particles) is further reduced to provide a more planar polishing surface.

In a representative embodiment, the first voltage applied to electric field element 110 may be tuned or otherwise configured to attract a monolayer of charged abrasive particles (e.g., as representatively illustrated in FIG. 5). In another representative embodiment, the second voltage applied to electric field element 110 may be tuned or otherwise configured to attract an additional monolayer of charged abrasive particles (e.g., as representatively illustrated in FIG. 6). In some embodiments, first and/or second voltages applied to electric field element 110 may be selected, tuned, or otherwise configured to attract one or more monolayers of charged abrasive particles.

After overall topographic variation of the polishing surface (e.g., comprising polishing pad 115 and one or more monolayers of charged abrasive particles) has been reduced, wafer 300 is polished by rotating polisher head 120 and/or polishing pad 115/electric field element 110/platen 105 (the polishing platform) as indicated by double-headed arrows 225 and 215 in FIG. 2, respectively. In some embodiments, polisher head 120 and the polishing platform may be rotated in a same direction. In other embodiments, polisher head 120 and the polishing platform may be rotated in opposite directions. By rotating wafer 300 against polishing pad 115, polishing pad 115 mechanically abrades bottommost layer 305 of wafer 300 to remove exposed material of bottommost layer 305. Reduced topographic variation of the polishing surface presented to affect polishing/planarization of wafer 300 produces a more uniform polishing/planarization of bottommost layer 305—that is to say, e.g., reduced topographic variation of the polishing surface produces reduced topographic variation of the planarized/polished surface of the workpiece.

In an embodiment the polish time may be between about 1 second and about 500 seconds, such as between about 60 sec and about 140 sec, such as 100 sec. The polishing process may be maintained at a temperature of between about 10° C. and about 60° C., such as between about 10° C. and about 50° C., such as about 30° C. The slurry flow may be maintained at a rate between about 50 cc/min and about 450 cc/min, such as between about 200 cc/min and about 400 cc/min, such as about 300 cc/min.

In some embodiments, a CMP process may be a one-step CMP process (e.g., where a single polishing pad 115 is used) or a multi-step CMP process. In a multi-step CMP process, polishing pad 115 may be used during a bulk CMP process. In such embodiments, wafer 300 may be removed from polishing pad 115 and may be transferred to a second polishing pad (not illustrated). The second polishing pad may perform a similar CMP process as described above, and the description is not repeated herein for brevity. In some embodiments, the second polishing pad may include a soft buffing pad, which may be configured to polish wafer 300 at a slower and more-controlled rate than the first polishing pad, while also buffing and eliminating defects and scratches that may have been produced during the bulk CMP process. The buffing CMP process may be continued until a desired amount of material has been removed from bottommost layer 305 of wafer 300. In some embodiments, timed or optical end-point detection methods may be used to determine when to discontinue polishing of wafer 300.

In preparation for a rinsing operation, wafer 300 is removed from polishing platform 105/110/115, and no voltage (e.g., zero voltage 1220, FIG. 12) is applied to electric field element 110. In a representative aspect, electric field element 110 may thus be regarded as "turned off" when no voltage is applied. As a result, arrangement 750 of charged abrasive particles (being neither attracted to, nor repelled from, polishing pad 115) have a quasi-random distribution relative to uppermost surface of polishing pad 115, as representatively illustrated in FIG. 7 (see also FIG. 4 prior to removal/lift-off of wafer 300).

Figure 8:
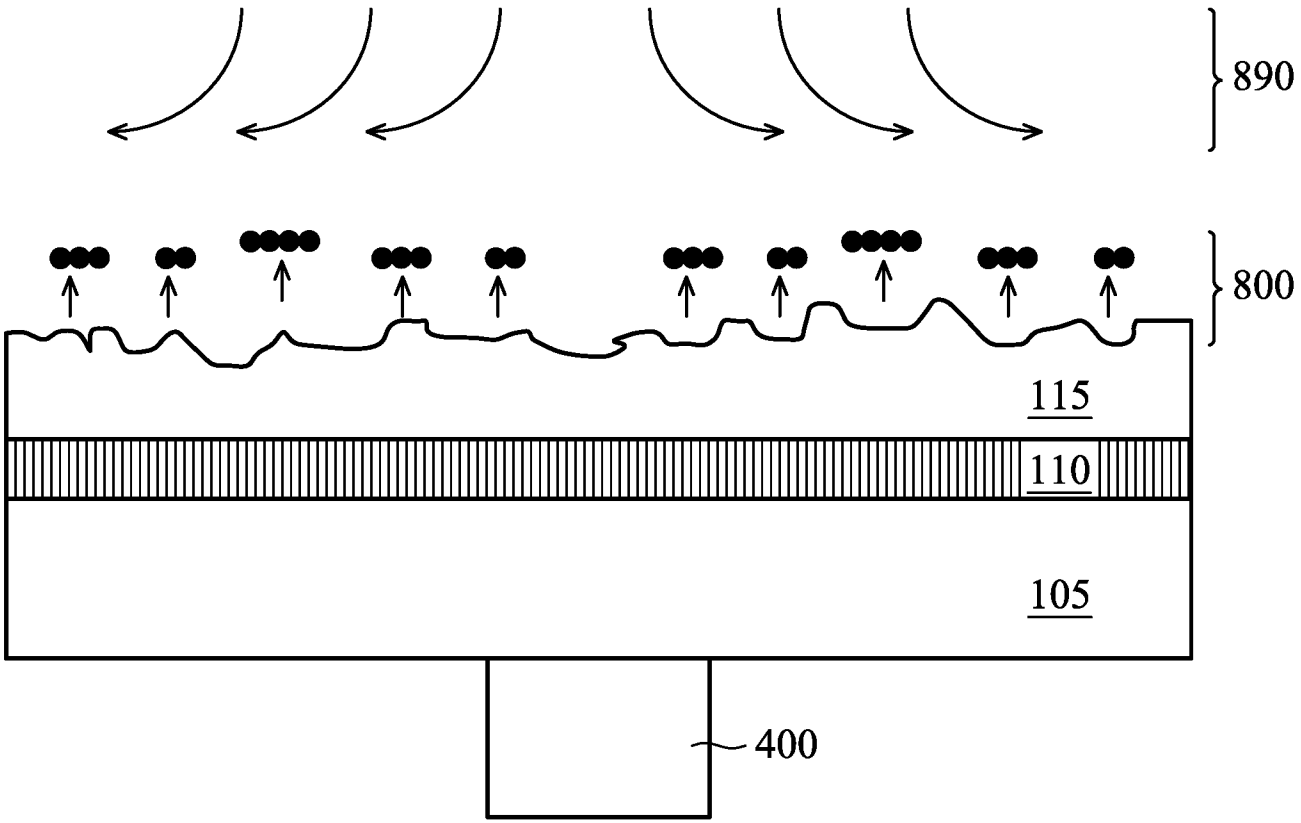

As representatively illustrated in FIG. 8, a voltage having a same polarity as that of the charged particles of the slurry 150 is applied to electric field element 110. Charge developed in/on electric field element 110, being of a same polarity as that of charged particles of the slurry 150, repels charged particles (arrangement 850) of the slurry 150 away from polishing pad 115. Conjunctively or sequentially, polishing pad 115 is rinsed with a cleaning solution 890—thereby removing repelled charged particles (arrangement 850). Cleaning solution 890 may include water, DI water, an alcohol, azeotropic mixtures thereof, an organic solvent, a surfactant, combinations of same, or the like.

Figure 9:
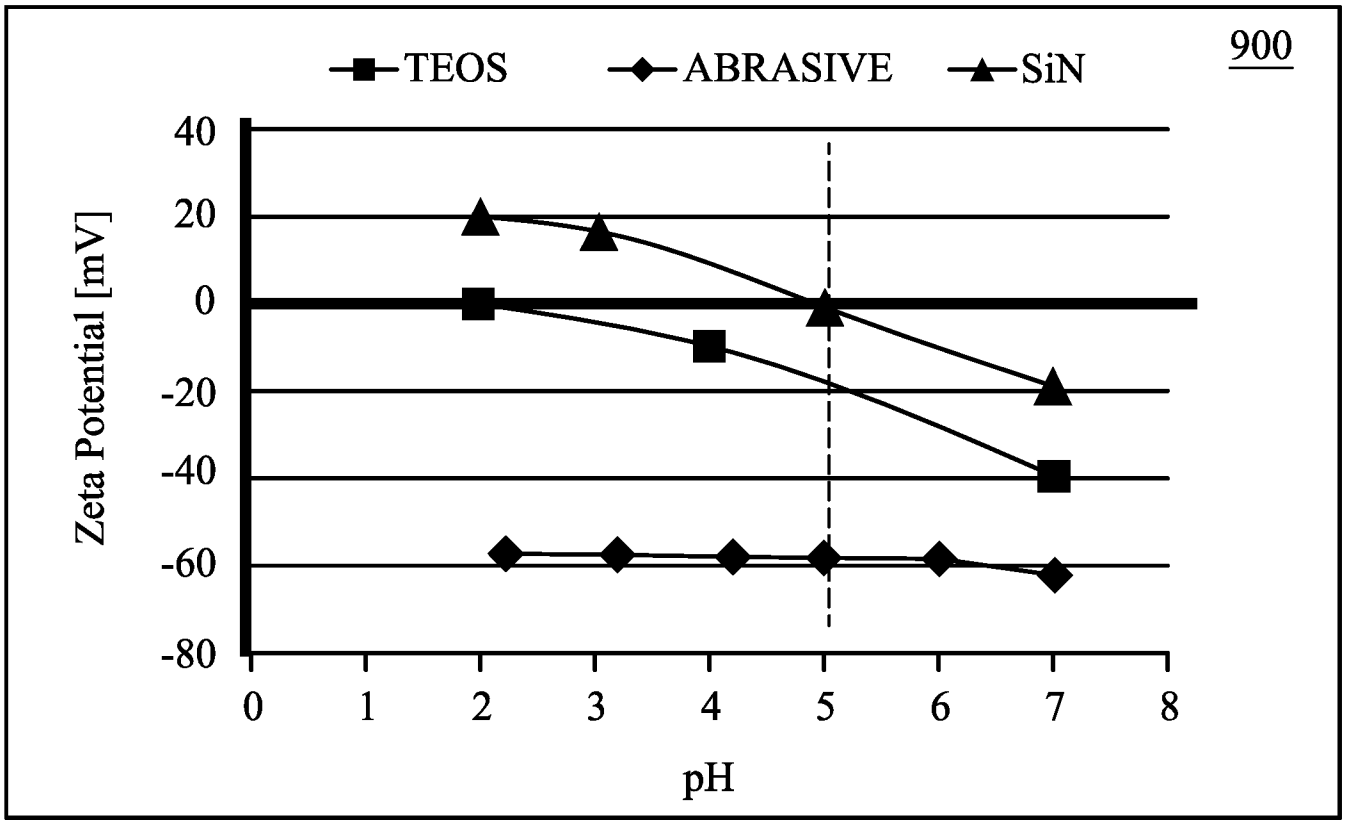
FIG. 9 illustrates electrokinetic charge profiles for representative polishing slurry materials as a function of pH, in accordance with some embodiments.

FIG. 9 representatively illustrates a graph 900 of zeta potentials for various materials (e.g., tetraethylorthosilicate (TEOS), representative CMP abrasive material, and silicon nitride (SiN)) as a function of negative log of $H_3O^+$ ion concentration (pH) of a CMP slurry composition. The zeta potential measures electrokinetic charge of slurry component particulates. For increasing pH of CMP slurry composition, the slurry particulates illustrated in FIG. 9 generally have an increasing negative charge. The vertical line around pH 5 shows silicon nitride having about no net charge (e.g., the isoelectric point of SiN), while representative abrasive slurry (e.g., a slurry with a colloidal silica abrasive with surface treatment (to either adsorbing anion polymers on the surface or chemically treat the surface with high electron negative elements), along with additives for hydrophilic adjustment, polish rate selectivity optimization, corrosion inhibition, and/or anti-bacteria for stability) material (zeta potential of about −60 mV) has a net negative charge about three times greater than that of TEOS particles (e.g., zeta potential of about −20 mV) at the same pH. Skilled artisans will appreciate that pH of the slurry solution may accordingly be tuned or otherwise configured (in combination with one or more voltages applied to electric field element 110) to produce a desired electrostatic attraction potential for charged particles of the slurry to fill-in lower-lying regions of a polishing pad in order to reduced overall topological variation of a polishing surface presented to a wafer to provide improved planarization. For example, a representative slurry solution containing abrasive particles comprising colloidal SiO2 may have a pH of about 3.5, and an electric field element may have an applied voltage of between about 50 volts and about 100 volts. It will be further appreciated that pH of the slurry solution may tuned or otherwise configured (in combination with one or more voltages applied to electric field element 110) to produce a desired electrostatic repulsion potential for improved cleaning or rinsing polishing pad 115. For example, for a representative slurry solution containing abrasive particles such as colloidal silicon oxide, the slurry solution may have a pH of about 3.5, and an electric field element of a polishing platform may be used to produce an electrostatic repulsion potential by having an applied voltage of between about −50 V volts and about −100 volts.

Figure 10:
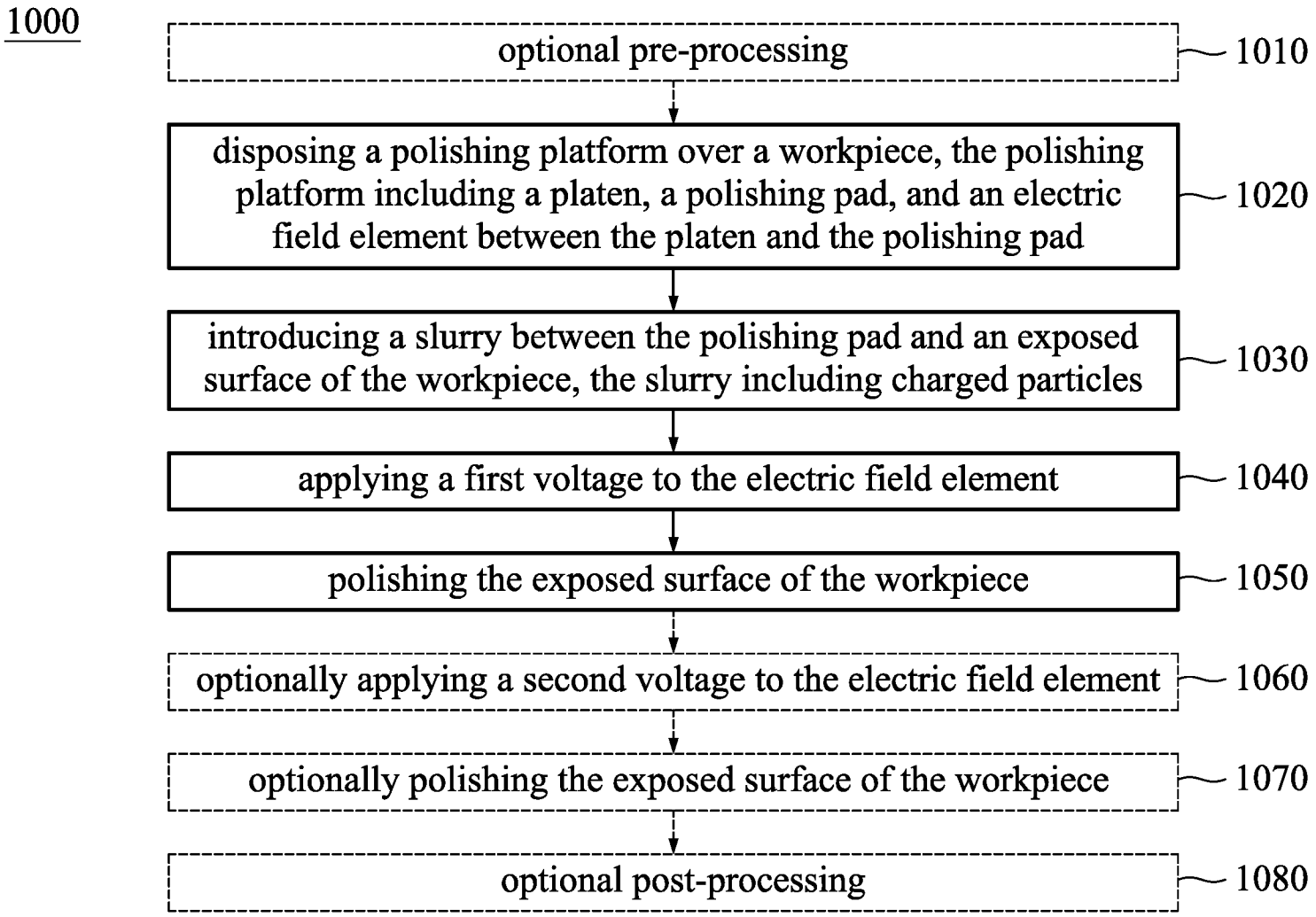
FIG. 10 representatively illustrates a flowchart for a polishing method, in accordance with some embodiments.

As representatively illustrated in FIG. 10, a method 1000 for improved planarization (or polishing) of a workpiece (e.g., a semiconductor wafer) includes a step of optional pre-processing (e.g., preparing a wafer for planarization, loading a wafer into a retaining ring of a polisher head, priming slurry flow lines, performing maintenance on various CMP apparatus components, combinations of same, or the like). In step 1020, a polishing platform (e.g., platen 105/electric field element 110/polishing pad 115) is positioned over a workpiece (e.g., wafer 300). In step 1030, a polishing slurry is introduced between the polishing pad of the polishing platform and an exposed surface of the workpiece. In representative aspects, the polishing slurry includes charged particles. In step 1040, a first voltage (e.g., having an opposite polarity compared to that of charged particles of the slurry) is applied to the electric field element of the polishing platform. A charge (having opposite polarity compared to that of charged particles of the slurry) is developed in/on the electric field element to attract charged particles of the slurry to fill in lower-lying surface portions of the polishing pad—thereby reducing overall topological variation of a combined polishing surface (e.g., formed by the polishing pad and attracted charged particles of the slurry) presented to the workpiece for planarizing the workpiece. In step 1050, the workpiece is polished/planarized by, e.g., chemical/mechanical action of slurry components abrading and removing exposed material of the workpiece. In optional step 1060, a second voltage (e.g., having an opposite polarity compared to that of charged particles of the slurry, and a magnitude greater than the first voltage) may be applied to the electric field element of the polishing platform. Additional charge (having opposite polarity compared to that of charged particles of the slurry) is developed in/on the electric field element to attract additional charged particles of the slurry to further fill in lower-lying surface portions of the polishing pad—thereby further reducing overall topological variation of the combined polishing surface presented to the workpiece for planarization. In optional step 1070, the workpiece may be further polished or planarized by chemical/mechanical action of slurry components abrading and removing material of the workpiece. Thereafter in step 1080, optional post-processing steps may be engaged (e.g., removing a wafer from a polisher_head, flushing slurry feed lines, performing maintenance on various CMP apparatus components, conditioning the polishing pad, rinsing the polishing pad, replacing the polishing pad, combinations of same, or the like).

Figure 11:
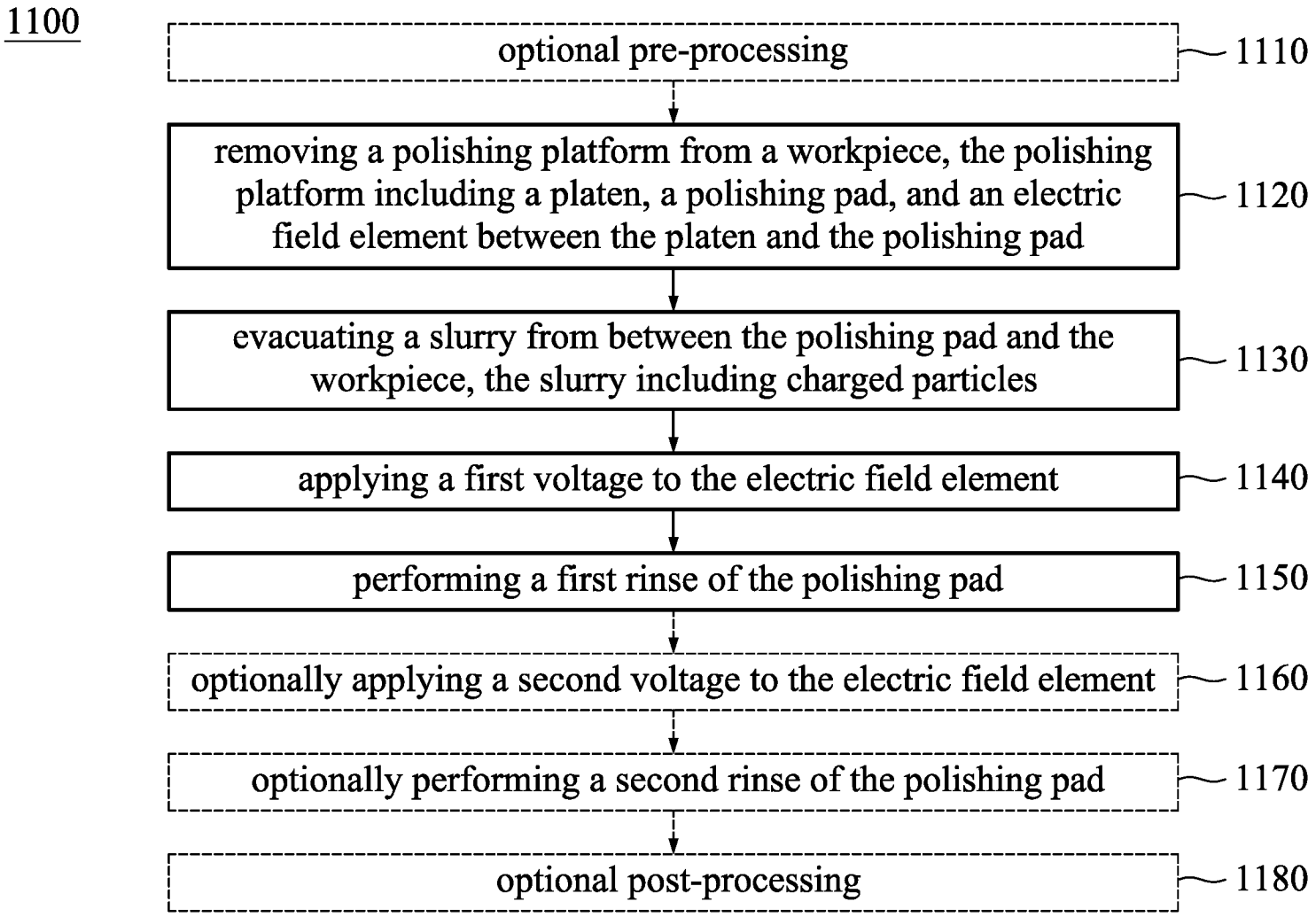
FIG. 11 representatively illustrates a flowchart for a rinsing/cleaning method, in accordance with some embodiments.

As representatively illustrated in FIG. 11, a method 1100 for rinsing or cleaning a polishing pad 115 includes a step 1110 of optional pre-processing (e.g., preparing a polishing pad for cleaning, conditioning a polishing pad, preparing a rinsing solution, priming flow lines with a rinsing or cleaning solution, combinations of same, or the like). In step 1120, a polishing platform (e.g., platen 105/electric field element 110/polishing pad 115) is removed from a workpiece (e.g., wafer 300). In step 1130, slurry is evacuated from between the polishing pad of the polishing platform and the workpiece. In representative aspects, the slurry includes charged particles. In step 1140, a first voltage (e.g., having a same polarity as that of charged particles of the slurry) is applied to the electric field element. Charge developed in/on the electric field element, being of a same polarity as that of charged particles of the slurry, repels charged particles of the slurry away from the polishing pad. In step 1150, the polishing pad is rinsed with a cleaning solution. The cleaning/rinsing solution may include water, DI water, an alcohol, azeotropic mixtures thereof, an organic solvent, a surfactant, combinations of same, or the like). In optional step 1160, a second voltage (e.g., having a same polarity as that of charged particles of the slurry, and having a greater magnitude than the first voltage) may be applied to the electric field element to improve repulsion of charged particles of the slurry away from the polishing pad. In optional step 1170, the polishing pad may be further rinsed with a cleaning solution. The cleaning solution in optional second rinsing step 1170 may be the same as, or different than, the cleaning solution used in first rinsing step 1150. Thereafter in step 1180, optional post-processing steps may be engaged (e.g., removing a wafer from a polisher head, flushing slurry feed lines, flushing rinse feed lines, performing maintenance on various CMP apparatus components, combinations of same, or the like).

Figure 12:
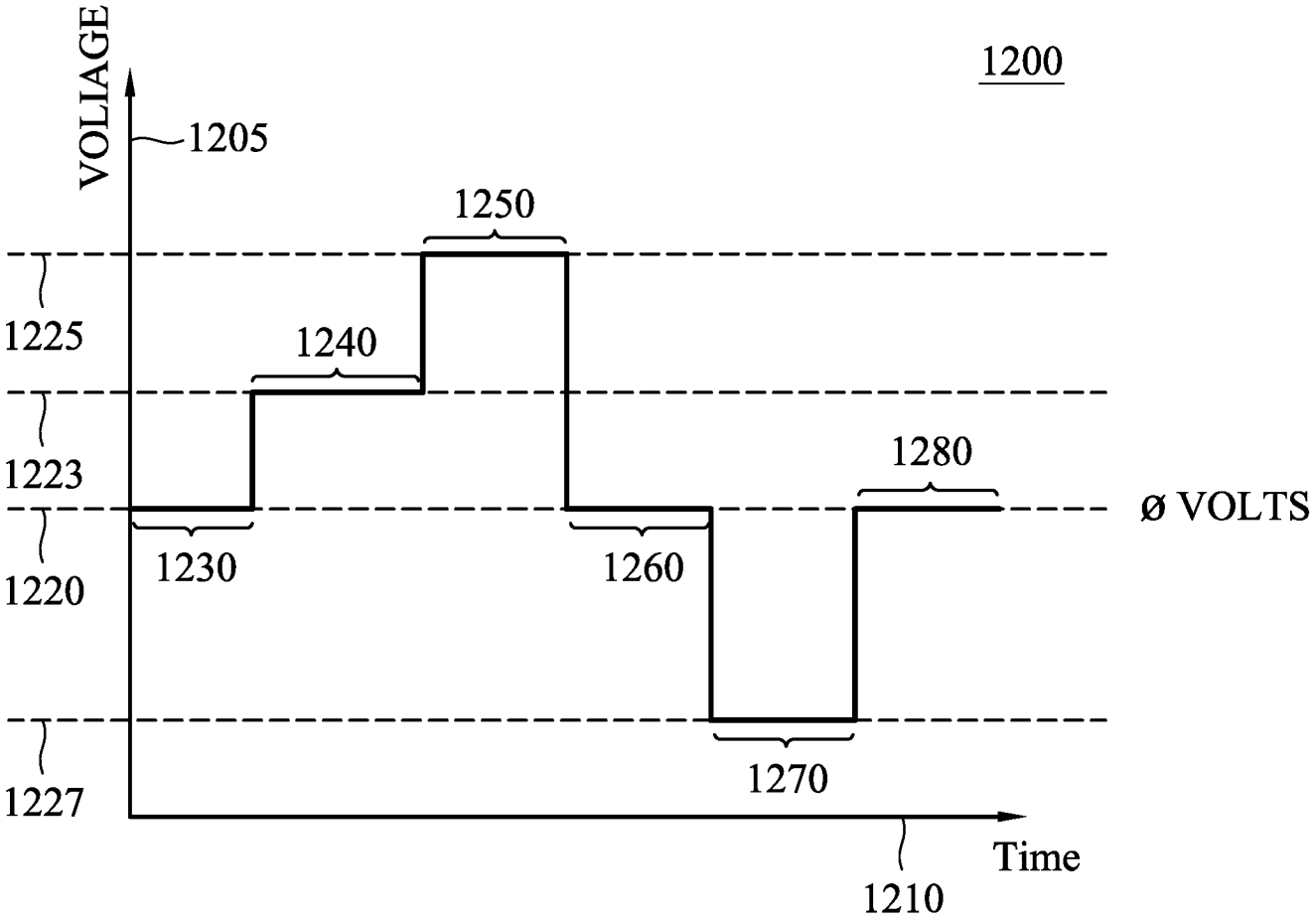
FIG. 12 representatively illustrates a voltage diagram for a voltage controller configured to perform polishing and rinsing methods, in accordance with some embodiments.

FIG. 12 illustrates a representative voltage profile 1200 produced by a voltage controller for variation of voltage 1205 applied to electric field element 110 as a function of time (1210) during a CMP process, in accordance with some embodiments. For example, during first time period 1230, no voltage (zero voltage 1220) is applied to electric field element 110 of the polishing platform for a time of about 15 seconds. In a representative aspect, first time period 1230 may correspond to electric field element 110 being "off." Thereafter during second time period 1240 of about 40 seconds, a first voltage 1223 such as about +30 volts, is applied to electric field element 110 (e.g., to attract one or more monolayers (arrangement 550) of oppositely charged abrasive particles of slurry 150 toward polishing pad 115, as representatively illustrated in FIG. 5). In a representative aspect, second time period 1240 may correspond to electric field element 110 being "on." In some embodiments, bottommost layer 305 of wafer 300 may be polished/planarized during second time period 1240. During third time period 1250 of about 20 seconds, a second voltage 1225 of about +50 volts is applied to electric field element 110 (e.g., to attract an additional one or more monolayers (arrangement 650) of oppositely charged abrasive particles of slurry 150 toward polishing pad 115, as representatively illustrated in FIG. 6). In some embodiments, second voltage 1225 has a same polarity (e.g., positive voltage) as first voltage 1223, and second voltage 1225 has a greater magnitude than first voltage 1223. In some embodiments, bottommost layer 305 of wafer 300 may be further polished/planarized during third time period 1250. During fourth time period 1260 of 10 seconds for a deionized water rinse, voltage applied to electric field element 110 is off (zero volts). Thereafter during fifth time period 1270 of about 10 seconds, a third voltage 1227 of about −50 volts is applied to electric field element 110 (e.g., to repel charged abrasive particles (arrangement 850) of slurry 150 away from polishing pad 115, as representatively illustrated in FIG. 8). In some embodiments, cleaning solution_890 may be applied to polishing pad 115 during fifth time period 1270. In some embodiments, third voltage 1227 is of opposite polarity (e.g., negative voltage) as compared to first voltage 1223 and second voltage 1225—thereby developing a charge on electric field element 110 that has a same polarity as charged abrasive particles (see arrangement 850). During sixth time period 1280, voltage applied to electric field element 110 is off (zero volts).

Figure 13:
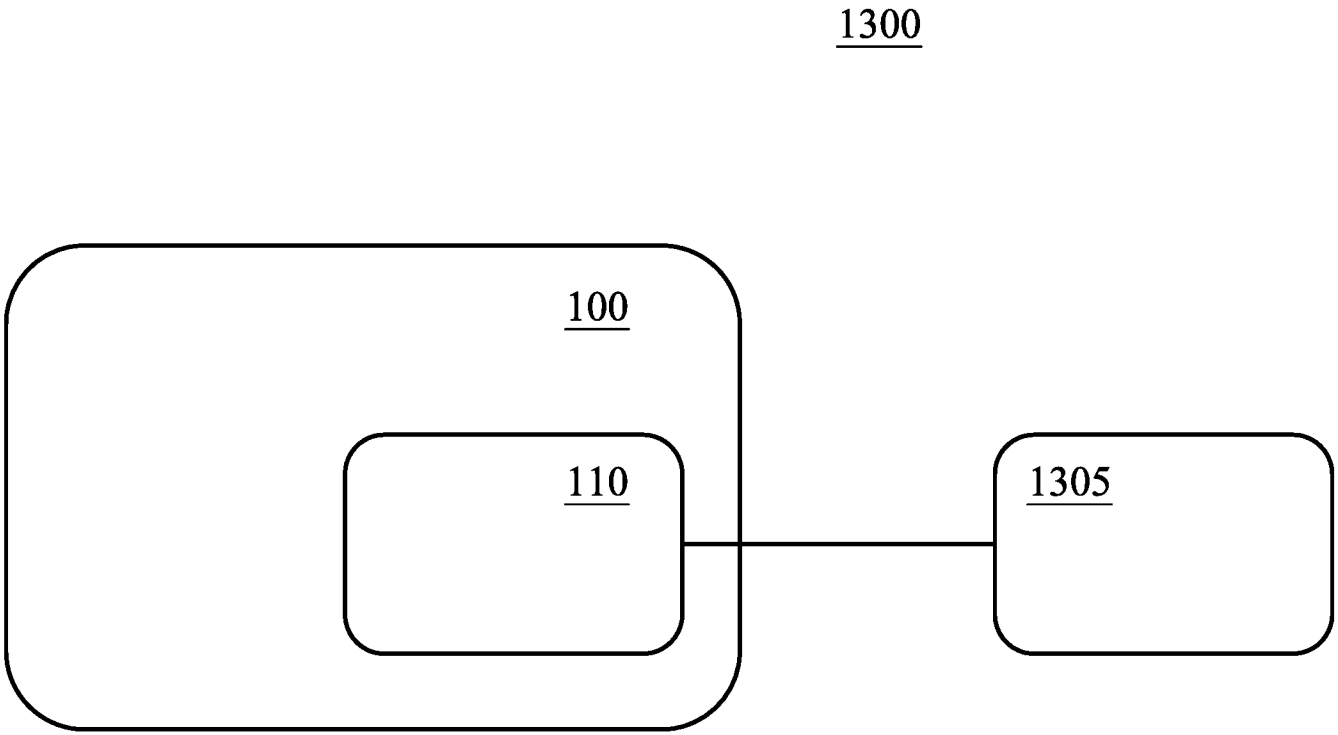
FIG. 13 representatively illustrates a block diagram of a CMP system, in accordance with some embodiments.

FIG. 13 representatively illustrates a block diagram of a CMP system 1300 that includes a voltage controller 1305 operatively connected to an electric field element 110 of a CMP apparatus 100, in accordance with some embodiments.

Various embodiments presented herein may provide several advantages. For example, a workpiece (e.g., semiconductor wafer) may be planarized to exhibit a more uniform or otherwise improved thickness that ranges from about 8 nm to about 2 nm, with a mean value of about 4 nm, and a standard deviation of about 1.5 nm. Various embodiments further allow for reduced polishing time and improved wafer-per-hour (WPH) throughput of a CMP apparatus.

In a representative embodiment, a method includes steps of: disposing a polishing platform over a workpiece, the polishing platform including a platen, a polishing pad, and an electric field element, the polishing pad disposed under the platen, the electric field element interposed between the platen and the polishing pad; introducing a polishing slurry between the polishing pad and an exposed surface of the workpiece, the polishing slurry including charged particles; applying a first voltage to the electric field element; and polishing the exposed surface of the workpiece. Applying the first voltage electrostatically attracts a plurality of the charged particles toward the polishing pad. After applying the first voltage, at least one monolayer of the charged particles is disposed on the polishing pad. The polishing pad has a first overall topographic variation. The at least one monolayer and the polishing pad include a first polishing surface. The first polishing surface has a second overall topographic variation. The second overall topographic variation is less than the first overall topographic variation. The method further includes a step of applying a second voltage to the electric field element, the second voltage having a same polarity as the first voltage, the second voltage greater than the first voltage. After applying the second voltage, at least another monolayer of the charged particles is disposed on the at least one monolayer. The at least another monolayer and the polishing pad include a second polishing surface. The second polishing surface has a third overall topographic variation. The third overall topographic variation is less than the second overall topographic variation. The electric field element includes a conductive plate or a conductive mesh.

In another representative embodiment, a method includes steps of: removing a workpiece from a polishing platform, the polishing platform including a platen, a polishing pad, and an electric field element, the electric field element interposed between the platen and the polishing pad; after removing the workpiece from the polishing platform, evacuating a polishing slurry from the polishing pad, the polishing slurry including charged particles; after evacuating the polishing slurry, applying a first voltage to the electric field element; and after applying the first voltage to the electric field element, rinsing the polishing pad. The method further includes steps of: before removing the workpiece from the polishing platform, introducing the polishing slurry between the polishing pad and an exposed surface of the workpiece; after introducing the polishing slurry, applying a second voltage to the electric field element, the second voltage different than the first voltage; and after applying the second voltage and before removing the workpiece from the polishing platform, polishing the exposed surface of the workpiece. The second voltage has a polarity opposite the first voltage. Applying the second voltage electrostatically attracts a plurality of the charged particles to the polishing pad. Applying the first voltage electrostatically repels a plurality of the charged particles away from the polishing pad. The electric field element includes a conductive plate or a conductive mesh.

In yet another representative embodiment, a polishing apparatus includes a polishing platform and a controller. The polishing platform includes: a platen; a polishing pad; and an electric field element interposed between the platen and the polishing pad. The controller is configured to apply a first voltage to electrically charge the electric field element. The controller is further configured to apply a second voltage to electrically charge the electric field element, the second voltage different than the first voltage. A first magnitude of the first voltage is less than a second magnitude of the second voltage. A first polarity of the first voltage is opposite a second polarity of the second voltage. The polishing apparatus further includes a conductive element interposed between the controller and the electric field element. The electric field element includes a conductive plate or a conductive mesh.

The foregoing outlines features of several embodiments so that those skilled in the art may better understand aspects of the present disclosure. Those skilled in the art will appreciate that they may readily use the present disclosure as a basis for designing or modifying other processes or structures for carrying out same or similar purposes, or for achieving same or similar advantages of embodiments discussed herein. Those skilled in the art will also realize that such equivalent constructions do not depart from the spirit and scope of the present disclosure, and that they may make various changes, substitutions, or alterations herein without departing from the spirit and scope of the present disclosure.

What is claimed is:

1. A method of manufacturing a semiconductor device, the method comprising:

distributing a chemical mechanical polishing slurry onto a platen; and applying a first voltage to an electric field element while the chemical mechanical polishing slurry is present on the platen, wherein the applying the first voltage electrostatically attracts oppositely charged abrasive particles within the chemical mechanical polishing slurry towards the platen;

applying a second voltage to the electric field element while the chemical mechanical polishing slurry is present on the platen, the second voltage being different from the first voltage;

removing the second voltage;

after the removing the second voltage, waiting; and after the waiting, applying a third voltage to the electric field element.

2. The method of claim 1, wherein the applying the third voltage repels the abrasive particles away from the platen.

3. The method of claim 2, further comprising applying a cleaning solution during the applying the third voltage.

4. The method of claim 1, wherein the first voltage is between 10 mV and 50 V.

5. The method of claim 4, wherein the second voltage is between 50 V and 100 V.

6. The method of claim 1, wherein the electric field element is a plate.

7. The method of claim 1, wherein the electric field element is a mesh.

8. A method of manufacturing a semiconductor device, the method comprising:

applying a chemical mechanical polishing slurry to a platen;

attracting a first monolayer of abrasives within the slurry to the platen with a first voltage;

attracting a second monolayer of abrasives within the slurry to the platen with a second voltage different from the first voltage;

removing the second voltage;

waiting a first period of time after the removing the second voltage; and after the waiting the first period of time, applying a third voltage.

9. The method of claim 8, wherein the attracting the first monolayer of abrasives is performed by applying the first voltage to a plate.

10. The method of claim 9, further comprising repelling the first monolayer of abrasives with the third voltage.

11. The method of claim 8, wherein the first monolayer of abrasives comprises aluminum oxide.

12. The method of claim 8, wherein the first monolayer of abrasives comprises silicon oxide.

13. The method of claim 8, wherein the first voltage is between 10 mV and 50 V.

14. The method of claim 8, wherein the second voltage is between 50 V and 100 V.

15. A method of manufacturing a semiconductor device, the method comprising:

applying a first voltage with a first polarity to an electric field element adjacent to a polishing pad;

applying a second voltage with the first polarity to the electric field element, the second voltage being different from the first voltage;

applying a third voltage with a second polarity opposite the first polarity to the electric field element;

removing the second voltage from the electric field element prior to the applying the third voltage; and waiting a first period of time after the removing the second voltage and the applying the third voltage.

16. The method of claim 15, further comprising dispensing a cleaning solution during the applying the third voltage.

17. The method of claim 15, further comprising dispensing a chemical mechanical polishing slurry during the applying the first voltage.

18. The method of claim 15, wherein the first voltage is between 10 mV and 50 V.

19. The method of claim 15, wherein the second voltage is between 50 V and 100 V.

20. The method of claim 15, wherein the third voltage has opposite polarity to both the first voltage and the second voltage.

* * * * *